United States Patent [19]

Killeen

[11] Patent Number: 4,998,349

[45] Date of Patent: Mar. 12, 1991

[54] KEY-CUTTING DEVICE

[75] Inventor: Gregory J. Killeen, Mentor, Ohio

[73] Assignee: Curtis Industries, Inc., Eastlake, Ohio

[21] Appl. No.: 399,630

[22] Filed: Aug. 28, 1989

[51] Int. Cl.[5] ..... B26D 5/10; B26F 1/12

[52] U.S. Cl. ..... 30/131; 83/414; 83/693; 83/917

[58] Field of Search ..... 83/205, 247, 917, 225, 83/226, 228, 263; 30/131, 277, 286, 229, 363; 81/3.7; 411/908, 907, 307, 392

[56] References Cited

U.S. PATENT DOCUMENTS

| | | | |
|---|---|---|---|
| 2,148,667 | 2/1939 | Yoskowitz et al. | 312/66 |
| 2,626,663 | 1/1953 | Abrams | 164/50 |
| 2,731,087 | 1/1956 | Cole | 164/50 |
| 3,102,571 | 12/1960 | Scott | 411/908 X |
| 3,352,301 | 11/1967 | Abelson | 81/3.7 |
| 3,384,141 | 7/1966 | Kort | 411/908 X |
| 3,633,451 | 1/1972 | Lieptz | 83/205 |
| 3,719,992 | 3/1973 | Reisher | 30/131 |
| 3,722,341 | 3/1973 | Hungerford, Jr. et al. | 83/413 |
| 4,468,994 | 9/1984 | Lieptz | 83/917 X |
| 4,562,759 | 1/1986 | Schmitt | 83/917 X |

*Primary Examiner*—Hien H. Phan
*Assistant Examiner*—Kenneth E. Peterson
*Attorney, Agent, or Firm*—Tarolli, Sundheim & Covell

[57] ABSTRACT

A key-cutting device includes a holder which holds the key blank. The holder is movable between initial and cutting positions. When the holder is in a cutting position, a cutter is moved to cut one or more notches in the key blank. An actuator is connected with the base to move the holder from the initial position to the cutting position. The actuator includes an improved saddle assembly in which a leaf spring is connected with a force transmitting member. A body of polymeric material is disposed between the leaf spring and the force transmitting member. Force is applied to a free end of the leaf spring to move the holder from the initial position to the cutting position. Upon continued operation of the actuator, the leaf spring is deflected about a fulcrum which is at least partially formed by the body of polymeric material. As the leaf spring is deflected, the body of polymeric material is resiliently compressed. The fulcrum extends across the width of the leaf spring to enable force to be transmitted between the fulcrum and the leaf spring across substantially the entire width of the leaf spring.

26 Claims, 3 Drawing Sheets

KEY-CUTTING DEVICE

BACKGROUND OF THE INVENTION

The present invention relates to a new and improved key-cutting device which is used to cut one or more notches in a key blank A key cutting device for cutting one or more notches in a key blank is disclosed in U.S. Pat. No. 3,633 451 issued Jan. 11, 1972 and entitled "Key-Cutting Machine With Coordinated Positioning and Cutting Movements". The key-cutting device disclosed in this patent includes a holder for holding a key blank in which notches are to be cut. The holder is movable between initial and cutting positions. A cutter is moved relative to the holder to cut notches in the key blank held by the holder when the holder is in a cutting position. An actuator performs the dual functions of first moving the holder to a cutting position and then moving the cutter to notch the key blank.

The actuator includes a saddle assembly having a saddle or member which pivots relative to a base of the key-cutting device to move the holder from the initial position to the cutting position. One end of a leaf spring is connected to the saddle member. A set screw extends through the saddle member and engages the leaf spring. After the key blank holder has been moved to a cutting position, continued operation of the actuator deflects the leaf spring about the end of the set screw.

During storage and/or use of the key-cutting device disclosed in the aforementioned U.S. Pat. No. 3,633,451, the leaf spring weakens. As the leaf spring weakens, the depths of cut by the punch may become shallow and erratic. The leaf spring will eventually weaken to a point where a key formed by notching a key blank will no longer open a lock. At this time, the saddle tension must be reset by turning the adjusting screw on top of the saddle member.

After the reset adjustment has been done several times, the saddle spring will break and a replacement is needed. If the set screw is turned too far in, that is, over-adjusted, a trigger on the key-cutting device will stick. The weakening of the saddle spring greatly increases the tolerances to which notches can be cut in a key blank. The operating life of the saddle assembly in a heavily used key-cutting device is approximately one month.

SUMMARY OF THE PRESENT INVENTION

The present invention provides a new and improved key-cutting device for use in cutting one or more notches in a key blank. The key-cutting device has an improved saddle assembly which has an operating life which is at least six times the operating life of the saddle assembly disclosed in the aforementioned U.S. Pat. No. 3,633,451. In addition, the saddle assembly does not require adjustment during its operating life. The improved saddle assembly enables key blanks to be cut with notches in a smaller tolerance range than could be achieved with the aforementioned prior art key-cutting device.

The improved saddle assembly includes a movable saddle or force transmitting member which moves a key holder. A leaf spring is connected with the force transmitting member. A body of polymeric material is disposed between the leaf spring and the force transmitting member.

During movement of the key holder from an initial position to a cutting position, the force transmitting member and leaf spring move together. During continued operation of an actuator for the key-cutting device with the key holder in the cutting position, the leaf spring is deflected about a fulcrum which is at least partially formed by the body of polymeric material. As the leaf spring is deflected, the body of polymeric material is resiliently compressed by the leaf spring. The body of polymeric material extends across substantially the entire width of the leaf spring to enable operating forces applied to the leaf spring and the fulcrum to be distributed over a relatively large area.

Accordingly, it is an object of this invention to provide a new and improved key-cutting device having an improved saddle assembly wherein a body of polymeric material is disposed between a leaf spring and a force transmitting member and wherein the leaf spring is deflected about a fulcrum which is at least partially formed by the body of polymeric material.

Another object of this invention is to provide a new and improved key-cutting device having an improved saddle assembly in which a body of resiliently compressible material is disposed between a spring and a saddle or force transmitting member, the body of material being resiliently compressible by the leaf spring as the leaf spring is deflected during operation of the key-cutting device.

Another object of this invention is to provide a new and improved key-cutting device having an improved saddle assembly wherein a fulcrum is disposed between a leaf spring and a force transmitting member and wherein the fulcrum extends across the width of the leaf spring to enable force to be transmitted between the fulcrum and the leaf spring across substantially the entire width of the leaf spring.

BRIEF DESCRIPTION OF THE DRAWINGS

The foregoing and other objects and features of the present invention will become more apparent upon a consideration of the following description wherein.

DESCRIPTION OF A SPECIFIC PREFERRED EMBODIMENT OF THE INVENTION

General Description

Figure 1:
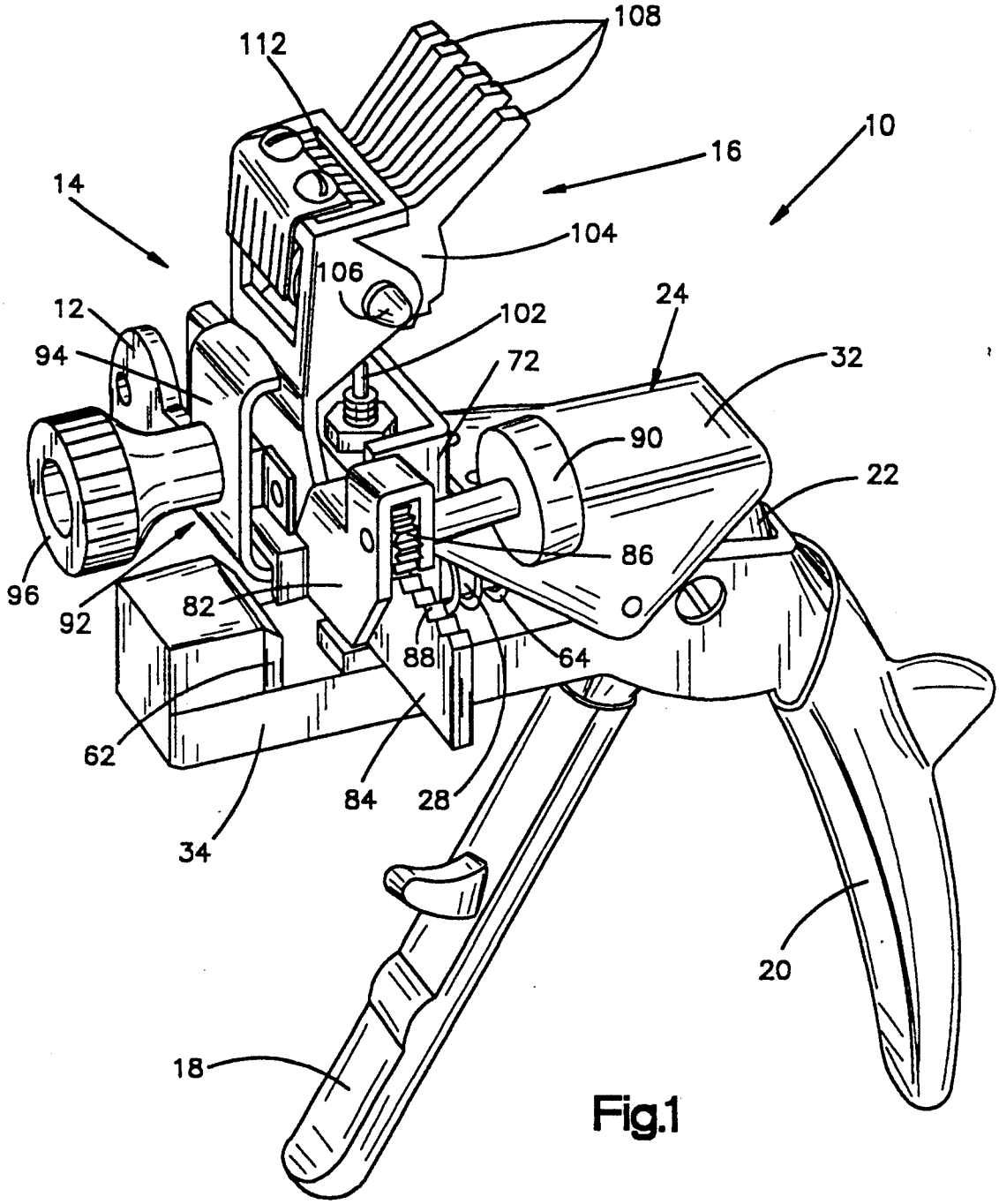
FIG. 1 is a pictorial illustration of a key-cutting device having an improved saddle assembly constructed in accordance with the present invention.

A key-cutting device 10 (FIG. 1) is operable to cut one or more notches in a key blank 12. The key-cutting device 10 is a portable and manually operable key-cutting machine which cuts notches in the key blank 12 in accordance with a numerical code. When the key blank 12 is to be cut, an operator of the key-cutting device 10 merely sets the key blank in a key holder assembly 14. A cam or depth gauge assembly 16 is then set to the numerical code corresponding to the notches to be cut in the key blank 12.

Once the key blank 12 has been mounted on the key holder assembly 14 and the cam assembly 16 set to the desired code number, a trigger 18 is manually actuated to effect operation of the key-cutting device 10. As the trigger 18 is pulled rearwardly toward a handle 20, a cam 22 (FIG. 2) on the upper end of the trigger 18 actuates an improved saddle assembly 24. The saddle assembly 24 moves the key holder assembly 14 from the initial position shown in FIG. 2 to any one of a plurality of cutting positions. As the key holder assembly 14 moves the key blank 12 to the cutting position, a lower edge portion of the key blank 12 moves into alignment with a shaped cutting edge 26 formed on a generally cylindrical punch 28. Continued actuation of the trigger 18 causes the cam 22 to move the punch 28 to notch the blank 12 while the key holder assembly 14 remains stationary in the cutting position.

The saddle assembly 24 includes a rigid metal saddle or force transmitting member 32. The force transmitting member 32 moves the key holder assembly 14 relative to a base frame 34 from the initial position illustrated in FIG. 2 to a cutting position. Continued actuation of the trigger 18 causes the cam 22 to deflect a metal leaf spring 36 about a fulcrum 38. As the leaf spring 36 is resiliently deflected about the fulcrum 38, the cam 22 moves the punch 28 to notch the key blank 12.

In accordance with a feature of the present invention, the fulcrum 38 (FIG. 3) minimizes stress concentration in the leaf spring 36 and minimizes the amount of deflection of the leaf spring to increase the service life of the saddle assembly 24. The fulcrum 38 is at least partially formed by a resiliently compressible body 42 of polymeric material. Although the fulcrum 38 is entirely formed by the body 42 of polymeric material in the illustrated embodiment of the invention, it is contemplated that the fulcrum 38 could include other elements, for example, a base plate could be disposed between body 42 of material and the leaf spring 36 or saddle 32. Although it is preferred to use an adhesive to secure the body 42 of polymeric material to the underside of the saddle 32, the body of polymeric material could be secured to the leaf spring 36 or could be connected with either the leaf spring or the saddle by any known connector means.

The body 42 of polymeric material has a relatively large area of engagement with the leaf spring 36. Thus, the body 42 of polymeric material extends across the width of the leaf spring 36 (FIG. 3), that is in a direction perpendicular to the longitudinal central axis of the leaf spring. Since the body 42 of polymeric material extends across the width of the leaf spring 36, the area of engagement of the leaf spring with the body of polymeric material tends to be maximized.

The body 42 of polymeric material has an area of engagement with the leaf spring 36 which increases longitudinally along the leaf spring as the leaf spring is deflected. Thus, as the leaf spring 36 is resiliently deflected by the cam 22 (FIG. 2) from the relaxed position shown in FIG. 4 to the fully deflected position shown in FIG. 5, the area of engagement between the body 42 of polymeric material and an upper side surface 46 of the leaf spring 36 increases from the relatively small area shown in FIG. 4 to the relatively large area shown in FIG. 5. By having a relatively large area of engagement between the body 42 of polymeric material and the leaf spring 36, stress concentration in the leaf spring tends to be minimized as the leaf spring is deflected.

Figure 4:
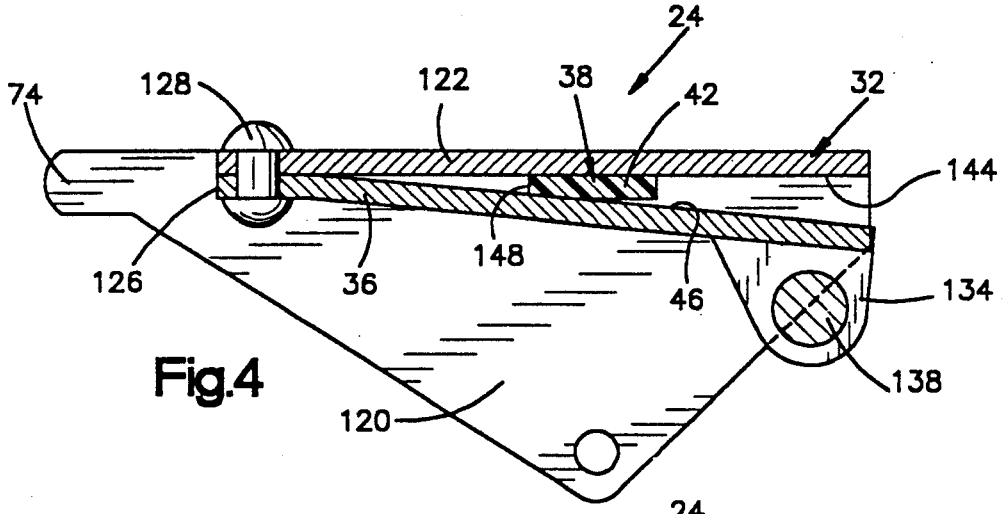
FIG. 4 is a sectional view, taken generally along the line 4—4 of FIG. 3, illustrating the relationship between a saddle or force transmitting member, a leaf spring, and a body of polymeric material prior to actuation of the key-cutting device.
Figure 5:
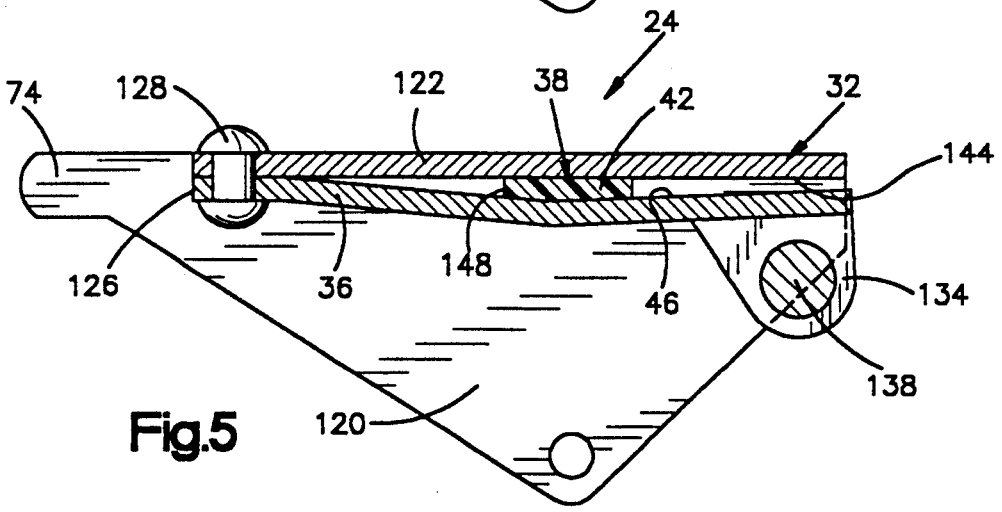
FIG. 5 is a sectional view, generally similar to FIG. 4, illustrating the relationship between the force transmitting member, leaf spring and body of polymeric material after the leaf spring has been deflected about the body of polymeric material.

As the leaf spring 36 is resiliently deflected from the relaxed position of FIG. 4 to the fully deflected position of FIG. 5, the body 42 of polymeric material is resiliently compressed to absorb operating forces applied against the leaf spring 36 by the cam 22. As the body 42 of polymeric material is compressed, the effective height of the fulcrum 38 is reduced with a resulting reduction in the distance through which the leaf spring 36 must be deflected as the punch 28 moves through a cutting stroke. Thus, the body 42 of polymeric material minimizes both stress concentrations in the leaf spring 36 and the distance through which the spring must be deflected. This substantially increases the number of times which the leaf spring 36 can be deflected by actuation of the key-cutting device 10 without the spring breaking.

Key-Cutting Device

Figure 2:
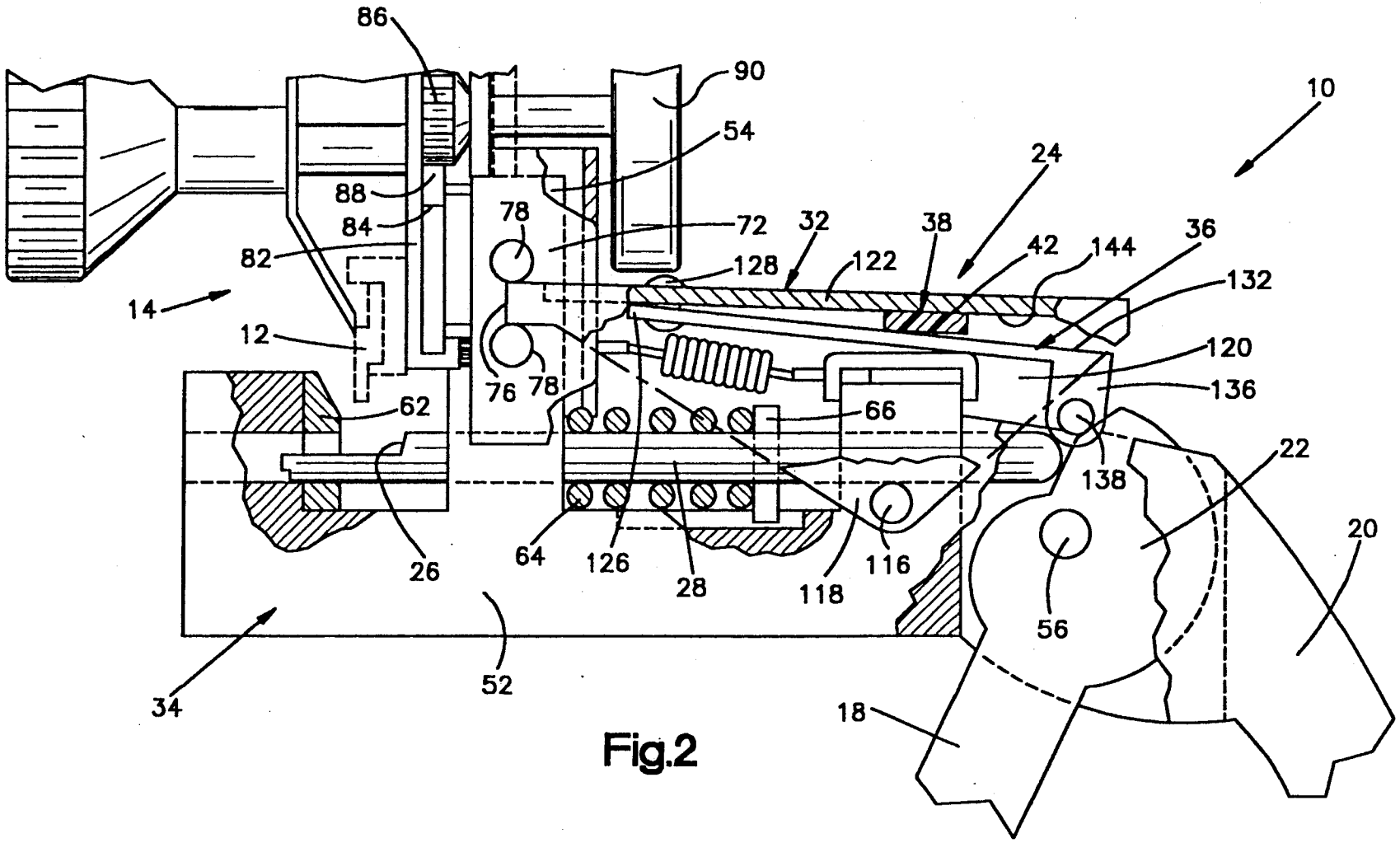
FIG. 2 is an enlarged, partially broken away, side elevational view of a portion of the key-cutting device of FIG. 1 and illustrating the relationship between the saddle assembly, a key blank holder and a punch which forms notches in a key blank held by the holder.

The key-cutting device 10 includes the rigid metal base frame 34 which is cast as one piece with the handle 20 (FIGS. 1 and 2). The generally cylindrical punch 28 is slidably mounted on a main section 52 (FIG. 2) of the base frame 34. An upstanding key holder assembly support post or section 54 is also cast as part of the frame 34. The trigger 18 is pivotally mounted at one end of the frame 34 on a support pin 56.

The punch 28 is movable axially relative to an anvil 62 which is connected to the base frame 34. A coil spring 64 extends between the key holder assembly support post 54 and a pin 66 extending through the punch 28. The spring 64 urges the punch 28 to the retracted position shown in FIG. 2.

Rotation of the cam 22 by actuation of the trigger 18 moves the cutting edge 26 (FIG. 2) on the punch toward the anvil 62. When the trigger 18 has been actuated to an extent sufficient to move the key holder assembly 14 to a cutting position, the cutting edge 26 will be to the right (as viewed in FIG. 2) of the key blank 12. Continued actuation of the trigger 18 results in the cutting edge 26 on the punch 28 pressing the key blank 12 against the anvil 22 and cutting a notch in the key blank 12.

The key holder assembly 14 includes a generally rectangular slide 72 which is axially movable along the rectangular post 54 on the base frame 34. The extent of downward movement (as viewed in FIG. 2) of the slide 72 determines the depth to which a notch is cut in the key blank 12 by the punch 28. The slide 72 is moved up and down along the post 54 by the saddle assembly 24. Thus, the saddle or force transmitting member 32 includes a pair of outwardly extending arms 74 and 76 (see FIG. 3) which engage pins 78 (FIG. 2) which extend outwardly from opposite sides of the slide 72.

A key transporter 82 (FIGS. 1 and 2) is movable along a track 84 which is fixedly secured to and forms part of the slide 72. Movement of the key transporter 82 along the track 84 indexes the key blank 12 relative to the punch 28. The transporter 82 is movable along the track 84 by rotation of a pinion 86 (FIG. 1)0 which engages a rack 88. The pinion 86 is rotated by turning a knob 90.

A clamp assembly 92 (FIG. 1) holds the key blank 12 in place on the transporter 82. The clamp assembly 92 includes a clamp member 94 which engages the key blank 12. A knob 96 is rotated to press the clamp member 94 against the key blank 12 to hold the key blank against movement relative to the transporter 82.

The cam assembly 16 (FIG. 1) is mounted on the upper end portion of the slide 72. The cam assembly 16 cooperates with a post 102 fixedly secured to the base frame 34 to determine the extent of movement of the key holder assembly 14 from the initial position to any one of a plurality of cutting positions. The cam assembly 16 includes a plurality of cam wheels 104 which are rotatable about a pin 106 by movement of handles 108. Numerals on the cam wheels 104 are exposed in a window 112 to indicate the positions of the cam wheels and the numerical code which will be cut in the key blank 12.

During operation of the key-cutting device 10, the trigger 18 is actuated to cause the saddle assembly 24 to lower the key holder assembly 14 until one of the cams 104 engages the post 102. Continued actuation of the trigger 18 results in the punch 28 cutting a notch in the key 12. The trigger 18 is then released to allow the key holder assembly 14 to return back to the initial position. A wire-form U-shaped lift spring (not shown) is provided to urge the key holder assembly 14 back to its initial position in the manner disclosed in U.S. Pat. No. 3,633,451.

The knob 90 is then rotated to cause the pinion 86 to move the transporter 82 along the track 84 to position the next succeeding location on the key blank 12 in alignment with the punch 28. The trigger 18 is then actuated to again lower the key holder assembly 14. When the next succeeding cam 104 engages the upstanding post 102, downward movement of the key holder assembly 14 is stopped, and, during continued actuation of the trigger 18, the punch 28 cuts a notch in the key holder at a second location. The foregoing steps are repeated until the key blank 12 has been fully cut with notches corresponding to the desired numerical code.

The saddle assembly 24 moves the key holder assembly 14 from the initial position to the cutting position when the trigger 18 is actuated. The saddle assembly 24 includes the saddle or force transmitting member 32 (FIGS. 3 and 4) which is pivotally connected with the base 34 (FIG. 2) by a support pin 116 which extends through the base 34 and engages openings in opposite sides of downwardly extending mounting sections 118 and 120 (FIGS. 2, 3 and 4) disposed on opposite sides of the frame 34. A saddle 32 has a generally rectangular cross or connector section 122 which extends between the downwardly extending mounting sections 118 and 120.

Figure 3:
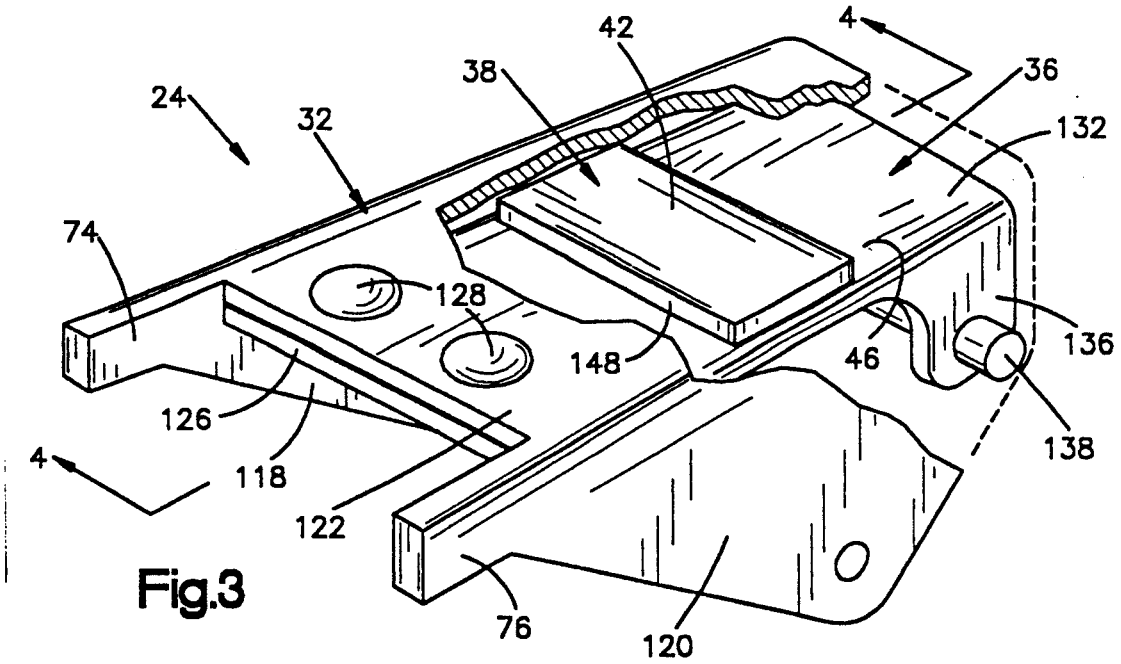
FIG. 3 is an enlarged, partially broken away, pictorial illustration of the saddle assembly.

The leaf spring 36 has a first or inner end portion 126 (FIGS. 2 and 4) which is fixedly connected to the connector section 122 of the saddle 32 by a pair of rivets 128 (FIG. 3). A second or outer end portion 132 of the leaf spring 36 has a pair of downwardly extending ears 134 and 136 (FIGS. 3 and 4) through which a cam follower roller 138 extends. The cam follower roller 138 is engaged by the actuator cam 22 (FIG. 2) to apply force to the leaf spring 36.

Upon initial actuation of the trigger and rotation of the cam 22, the cam applies force against the roller 138 to pivot the saddle assembly 24 in a counterclockwise direction (as viewed in FIG. 2) about the support pin 116 to move the key holder assembly 14 downwardly from the initial position to a cutting position. During this movement of the key holder assembly 14 from the initial position to the cutting position, the punch 28 is moved by the cam 22 to position the cutting edge 26 adjacent to and rightwardly (as viewed in FIG. 2) of the key blank 12. The downward movement of the key holder assembly 14 stops with the key holder assembly in a selected cutting position by engagement of one of the cam wheels 104 (FIG. 1) with the post 102.

Continued actuation of the trigger 18 after the key holder assembly 14 has moved to the cutting position continues the movement of the punch 28 toward the anvil 62. However, the key holder assembly 14 remains stationary. The force applied by the cam 22 to the cam follower roller 138 (FIG. 2) during continued actuation of the trigger 18 with the key holder assembly 14 in a cutting position results in the leaf spring 36 being resiliently deflected. Thus, the cam 22 deflects the leaf spring 36 in a counterclockwise direction (as viewed in FIG. 2) about the fulcrum 38. As this occurs, the leaf spring 36 is deflected upwardly from the relaxed position of FIG. 4 to the fully deflected position of FIG. 5 while the force transmitting member 32 and the key holder assembly 14 remains stationary relative to the base frame 34.

With the exception of the fulcrum 38, the construction and mode of the key-cutting device 10 is the same as is described in U.S. Pat. No. 3,633,451. The various operating components of the key-cutting device 10, with the exception of the fulcrum 38, are the same as is found in a No. 15 Cam-Set Code Cutter sold by Curtis Industries, Inc., of Eastlake, Ohio.

Saddle Assembly

The improved saddle assembly 24 has a fulcrum 38 which is constructed in accordance with the present invention. The fulcrum 38 (FIG. 3) is formed by a body 42 of polymeric material. Although it is believed that many different polymeric materials could be used, in one specific instance, the body 42 of polymeric material was formed of a polyurethane die rubber. This polyurethane die rubber is commercially available from Producto Corp. of Cleveland, Ohio under the designation "Pro Flex" polyurethane (orange). The polyurethane die rubber has a durometer hardness of 90.

It should be understood that other known polymeric materials could be utilized to form the fulcrum 38 if desired. In fact, if desired, the fulcrum 38 could be formed of a material other than a polymeric material. However, the above-described polyurethane die rubber has been found to have a very long service life and is believed to be particularly satisfactory.

The body 42 of polymeric material has a width which is the same as the width of the leaf spring 36 (see FIG. 3). Thus, the body 42 of polymeric material extends between opposite longitudinally extending edge portions of the leaf spring 36. Therefore, when the leaf spring 36 is deflected around the fulcrum 38, the fulcrum 38 is effective to apply force against the leaf spring throughout the width of the leaf spring. Since the fulcrum 38 extends across the width of the leaf spring 36, the fulcrum would tend to minimize stress concentrations in the leaf spring even if the fulcrum was formed of a material other than the body 42 of polymeric material.

The body 42 of polymeric material has a rectangular configuration and is fixedly connected with a flat bottom side surface 144 (FIG. 4) of the connector section 122 of the saddle or force transmitting member 32. The rectangular body 42 of polymeric material is precompressed adjacent to the lower left (as viewed in FIG. 4) corner of the polymeric material by the leaf spring 36.

In one specific embodiment of the invention, the body 42 of polymeric material was a rectangular block (FIG. 3). The rectangular block measured 0.5 by 0.25 by 0.075 inches. The leaf spring 36 had a width of 0.5 inches. The body 42 of polymeric material was located with a rightward (as viewed in FIG. 4) minor side 148 approximately 0.785 inches from the center of the rivets 128 attaching the end portion 126 of the leaf spring 36 to the saddle member 32. The side 148 has a length of 0.5 inches. In this specific embodiment of the invention, the 0.5 inch dimension of the body of polymeric material extends across the leaf spring 36 and the 0.25 dimension extends parallel to the longitudinal axis of the spring 36.

Although the foregoing construction and mounting of the body 42 of polymeric material are presently preferred, it is contemplated that the body 42 of polymeric material could be formed with different dimensions and could be placed in different locations relative to the spring 36 and saddle 32. The foregoing specific example of the dimensions of the body 42 of polymeric material and its location in the saddle assembly 24 have been set forth for purposes of clarity of description and not for purposes of limitation of the invention. It is also contemplated that the body 42 of polymeric material could have a configuration other than the illustrated rectangular configuration. For example, the body of polymeric material could have a triangular configuration corresponding to the configuration of the space between the leaf spring 36 and connector section 122 of the saddle member 32. If desired, the body 42 of polymeric material could have an arcuate or semi-circular configuration. Although it is preferred to attach the body 42 of polymeric material to the underside 144 of the saddle member 32, the body of polymeric material could be attached to the leaf spring 36 if desired.

When a key blank 12 (FIG. 1) is to be cut in the key-cutting device 10, the key blank is mounted on the transporter 82 and the cam wheels 104 are set to the numerical code of the notches to be cut in the key.

The trigger 18 is then actuated to rotate the cam 22. Rotation of the cam 22 (FIG. 2) applies force against the cam follower roller 138 to pivot the saddle assembly 24 in a counterclockwise direction (as viewed in FIG. 2) about the saddle mounting pin 116. As this occurs, the leaf spring 36 and saddle member 32 move together and the key holder assembly 14 moves downwardly relative to the frame 34.

When the key holder assembly 14 has moved downwardly relative to the frame 34, through a distance determined by the setting of the cam wheels 104, to a cutting position, downward movement of the key holder assembly 14 stops and pivoting movement of the saddle or force transmitting member 32 stops. However, the trigger 18 continues to be actuated to continue the rotation of the cam 22 and movement of the punch 28.

As the cam 22 continues to rotate, the leaf spring 36 is resiliently deflected relative to the stationary saddle member 32. As the leaf spring 36 is deflected around the fulcrum 38, the body 42 of polymeric material is compressed. This results in the forces applied against the cam follower roller 138 by the cam 22 being absorbed by both deflection of the leaf spring 36 and compression of the body 42 of polymeric material.

As the body 42 of polymeric material is resiliently compressed, the distance which the body 42 of polymeric material extends outwardly from the lower side surface 144 of the saddle member 32 decreases. This decreases the distance through which the leaf spring 36 must be deflected. In addition, the arc of curvature of the deflected spring 36 is increased.

As the leaf spring 36 moves from the relaxed position of FIG. 4 to the fully deflected position of FIG. 5 during continued rotation of the cam 22, the extent of engagement of the upper side 46 of the leaf spring with the body 42 of polymeric material increases. This results in the forces being transmitted between the fulcrum 38 and the leaf spring 36 being spread over a relatively large area to avoid stress concentrations in the leaf spring. The application of force over a relatively large area on the leaf spring 36 is also contributed to by the fact that the fulcrum 38 extends across the entire width of the leaf spring 36.

Conclusion

In view of the foregoing description, it is apparent that the present invention provides a new and improved key-cutting device 10 for use in cutting one or more notches in a key blank 12. The key-cutting device 10 has an improved saddle assembly 24 which has an operating life which is at least six times the operating life of the saddle assembly disclosed in the aforementioned U.S. Pat. No. 3,633,451. In addition, the saddle assembly 24 does not require adjustment during its operating life. The improved saddle assembly 24 enables key blanks 12 to be cut with notches in a smaller tolerance range than could be achieved with the aforementioned prior art key-cutting device.

The improved saddle assembly 24 includes a movable saddle or force transmitting member which moves a key holder 14. A leaf spring 36 is connected with the force transmitting member. A body 42 of polymeric material is disposed between the leaf spring and the force transmitting member. During movement of the key holder 14 from an initial position to a cutting position, the force transmitting member 32 and leaf spring 36 move together.

During continued rotation of the cam 22 by the trigger 18, the leaf spring 36 is deflected about a fulcrum which is at least partially formed by the body 42 of polymeric material. As the leaf spring 36 is deflected, the body 42 of polymeric material is resiliently compressed by the leaf spring. The body 42 of polymeric material extends across substantially the entire width of the leaf spring 36 to enable operating forces applied to the leaf spring and the fulcrum 38 to be distributed over a relatively large area.

Although it is preferred to form the fulcrum 38 of a polymeric material, it is contemplated that the fulcrum could be formed of other known materials if desired. While the improved saddle assembly 24 is advantageously utilized in a key-cutting device having the construction shown in U.S. Pat. No. 3,633,451, it is contemplated that the improved saddle assembly may be used in key cutting devices having a different construction. For example, the improved saddle assembly 24 could be used in a key-cutting device which is not portable and/or a key-cutting device which is not manually actuated.

Having described a specific preferred embodiment of the invention, the following is claimed:

1. A key-cutting device for use in cutting one or more notches in a key blank, said key-cutting device comprising a base, holder means for holding a key blank in which one or more notches are to be cut, said holder means being movable relative to said base between initial and cutting positions, cutter means movable relative to said base to cut one or more notches in a key blank held by said holder means when said holder means is in a cutting position, and actuator means connected with said base for moving said holder means from the initial position to a cutting position, said acutator means including a movable force transmitting member, a leaf spring connected with said force transmitting member, a body of polymeric material disposed between said leaf spring and said force transmitting member, and means for applying force to said leaf spring to move said holder means from the initial position to a cutting position by moving said force transmitting member and leaf spring relative to said base and to deflect said leaf spring relative to said force transmitting member about a fulcrum which is at least partially formed by said body of polymeric material upon continued operation of said actuator means after said holder means has moved from the initial position to the cutting position.

2. A key-cutting device as set forth in claim 1 wherein said actuator means further includes means for moving said cutter means relative to said base during continued operation of said actuator means after said holder means has moved from the initial position to the cutting position.

3. A key-cutting device as set forth in claim 1 wherein said body of polymeric material is resiliently compressed by said leaf spring upon operation of said actuator means.

4. A key-cutting device as set forth in claim 1 wherein said body of polymeric material has an area of engagement with said leaf spring which increases during operation of said actuator means.

5. A key-cutting device for use in cutting one or more notches in a key blank, said key-cutting device comprising a base, holder means for holding a key blank in which one or more notches are to be cut, said holder means being movable relative to said base between initial and cutting positions, cutter means movable relative to said base to cut one or more notches in a key blank held by said holder means when said holder means is in a cutting position, and actuator means connected with said base for moving said holder means from the initial position to a cutting position, said actuator means including a movable force transmitting member, a leaf spring connected with said force transmitting member, a body of polymeric material disposed between said leaf spring and said force transmitting member, said body of polymeric material having an extent transverse to a longitudinal central axis of said leaf spring which is at least substantially as great as the extent of said leaf spring in a direction transverse to the longitudinal central axis of said leaf spring and parallel to a major side surface of said leaf spring, and means for applying force to said leaf spring to move said holder means from the initial position to a cutting position by moving said force transmitting member and leaf spring relative to said base and to deflect said leaf spring relative to said force transmitting member about a fulcrum which is at least partially formed by said body of polymeric material upon continued operation of said actuator means after said holder means has moved from the initial position to the cutting position, said body of polymeric material being resiliently compressed by said leaf spring upon operation of said actuator means and having an area of engagement with said leaf spring which increases during operation of said actuator means and compression of said body of polymeric material.

6. A key-cutting device as set forth in claim 1 wherein said leaf spring has a first end portion fixedly connected with said force transmitting member and a second end portion which is movable relative to said force transmitting member, said leaf spring being deflected about the fulcrum which is disposed intermediate said first and second end portions of said leaf spring during continued operation of said actuator means.

7. A key-cutting device as set forth in claim 1 wherein said body of polymeric material is disposed in abutting engagement with said leaf spring.

8. A key-cutting device as set forth in claim 1 wherein said body of polymeric material has a first area of abutting engagement with said leaf spring prior to initiation of operation of said actuator means and has a second area of abutting engagement with said leaf spring after deflection of said leaf spring during continued operation of said actuator means, said second area being greater than said first area.

9. A key-cutting device as set forth in claim 1 wherein said body of polymeric material is connected with said force transmitting member for movement therewith during operation of said actuator means.

10. A key-cutting device as set forth in claim 1 wherein said actuator means is manually operable to move said holder means relative to said base.

11. A key-cutting device as set forth in claim 1 wherein said force transmitting member is pivotally connected to said base and is pivotal by said actuator means relative to said base during operation of said actuator means to move said holder means from the initial position to a cutting position.

12. A key-cutting device as set forth in claim 1 further including depth gauge means for controlling the distance through which said holder means moves from the initial position to a cutting position to thereby control the depth of a notch cut in the key blank by operation of said cutter means.

13. A key-cutting device as set forth in claim 1 wherein said cutter means includes a punch which is moved relative to said base by said actuator means to cut a notch in a key blank during continued operation of said actuator means after said holder means has moved from the initial position to the cutting position.

14. A key-cutting device as set forth in claim 1 wherein said holder means includes a carriage, clamp means for holding a key blank against movement relative to said carriage, track means for guiding movement of said carriage along a path extending transversely to a path of movement of said holder means between the initial and cutting positions, and index means for moving said carriage along said track means to position a key blank on said carriage relative to said cutter means.

15. A key-cutting device as set forth in claim 1 wherein said body of polymeric material has an extent transverse to a longitudinal central axis of said leaf spring which is at least substantially as great as the extent of said leaf spring in a direction transverse to the longitudinal central axis of said leaf spring and parallel to a major side surface of said leaf spring.

16. A saddle assembly for use in a key-cutting device in which a cutter is movable relative to a base to cut one or more notches in a key blank held by a holder assembly after the holder assembly has been moved from an initial position to a cutting position by operation of an actuator assembly, said saddle assembly comprising a force transmitting member having a first end portion with means for transmitting force from said force transmitting member to the holder assembly to move the holder assembly between the initial and cutting positions, a leaf spring having a first end portion fixedly connected to said force transmitting member and second end portion movable by the actuator assembly, and a body of polymeric material disposed between said leaf spring and said force transmitting member to form a fulcrum about which said leaf spring is deflected under the influence of force applied to the second end portion of said leaf spring by the actuator assembly upon continued operation of the actuator assembly and movement of the second end portion of said leaf spring relative to said force transmitting member after the holder assembly has moved from the initial position to a cutting position.

17. A saddle assembly as set forth in claim 16 wherein said body of polymeric material is resiliently compressible by said leaf spring upon movement of the second end portion of said leaf spring relative to said force transmitting member by the actuator assembly after the holder assembly has moved to a cutting position.

18. A saddle assembly as set forth in claim 16 wherein said force transmitting member and leaf spring have elongated configurations, said leaf spring having a longitudinal axis which is skewed at an acute angle relative to a longitudinal axis of said force transmitting member when the holder assembly is in the initial position, said body of polymeric material having an extent transverse to the longitudinal axis of said leaf spring which is at least substantially as great as the extent of said leaf spring in a direction transverse to the longitudinal central axis of said leaf spring and parallel to a major side surface of said leaf spring.

19. A saddle assembly as set forth in claim 16 wherein said body of polymeric material is fixedly connected with said force transmitting member and is disposed in abutting engagement with said leaf spring when the holder assembly is in a cutting position.

20. A key-cutting device for use in cutting one or more notches in a key blank, said key-cutting device comprising a base, holder means for holding a key blank in which one or more notches are to be cut, said holder means being movable relative to said base between initial and cutting positions, cutter means movable relative to said base to cut one or more notches in a key blank held by said holder means when said holder means is in a cutting position, and actuator means connected with said base for moving said holder means from the initial position to a cutting position, said acutator means including a movable force transmitting member, a spring connected with said force transmitting member, a body of resiliently compressible material disposed between said spring and said force transmitting member, and means for applying force to said spring to move said holder means from the initial position to a cutting position by moving said force transmitting member, body of material, and spring together relative to said base, said actuator means being operable to move said spring relative to said force transmitting member to resiliently deflect said spring and to resiliently compress said body of material upon continued operation of said actuator means after said holder means has moved from the initial position to the cutting position.

21. A key-cutting device as set forth in claim 20 wherein said spring is formed of metal and said body of material is at least partially formed of a polymeric material.

22. A key-cutting device as set forth in claim 20 wherein said body of material has an area of engagement with said leaf spring which increases during operation of said actuator means with said holder means in a cutting position.

23. A key-cutting device as set forth in claim 18 wherein said body of material has a first area of abutting engagement with said spring prior to initiation of operation of said actuator means to move said holder means and has a second area of abutting engagement with said spring after deflection of said spring during continued operation of said actuator means, said second area being greater than said first area.

24. A key-cutting device as set forth in claim 20 wherein said spring is a leaf spring, said body of material has an extent transverse to a longitudinal central axis of said leaf spring which is at least substantially as great as the extent of said leaf spring in a direction transverse to the longitudinal central axis of said leaf spring and parallel to a major side surface of said leaf spring.

25. A key-cutting for use in cutting one or more notches in a key blank, said key-cutting device comprising a base, holder means for holding a key blank in which one or more notches are to be cut, said holder means being movable relative to said base between initial and cutting positions, cutting means movable relative to said base to cut one or more notches in a key blank held by said holder means when said holder means is in a cutting position, and actuator means connected with said base for moving said holder means from the initial position to a cutting position, said actuator means including a movable force transmitting member, a leaf spring connected with said force transmitting member, a fulcrum dispose between said leaf spring and said force transmitting member, and means for applying force to said leaf spring to move said holder means from the initial position to a cutting position by moving said force transmitting member and leaf spring relative to said base and to deflect said leaf spring about said fulcrum upon continued operation of said actuator means after said holder means has moved from the initial position to the cutting position, said fulcrum having an extent transverse to a longitudinal central axis of said leaf spring which is at least substantially as great as the extent of said leaf spring in a direction transverse to the longitudinal central axis of said leaf spring and parallel to a major side surface of said leaf spring said fulcrum being at least partially formed by a body of polymeric material which is compressed upon operation of said actuator means.

26. A key-cutting device as set forth in claim 25 wherein said fulcrum is connected with said force transmitting member for movement therewith relative to said base.

* * * * *

UNITED STATES PATENT AND TRADEMARK OFFICE

CERTIFICATE OF CORRECTION

PATENT NO. : 4,998,349

DATED : March 12, 1991

INVENTOR(S) : Gregory J. Killeen

It is certified that error appears in the above-identified patent and that said Letters Patent is hereby corrected as shown below:

Column 12, Line 15, Claim 23, change "18" to --20--.

Column 12, Line 31, Claim 25, insert --device-- after "key-cutting".

Signed and Sealed this

Twenty-eighth Day of July, 1992

*Attest:*

DOUGLAS B. COMER

*Attesting Officer*

*Acting Commissioner of Patents and Trademarks*